US011988001B2

(12) United States Patent
Marshall

(10) Patent No.: US 11,988,001 B2
(45) Date of Patent: May 21, 2024

(54) IMPALEMENT HAZARD PROTECTIVE CAP

(71) Applicant: Jeffrey Marshall, Costa Mesa, CA (US)

(72) Inventor: Jeffrey Marshall, Costa Mesa, CA (US)

( * ) Notice: Subject to any disclaimer, the term of this patent is extended or adjusted under 35 U.S.C. 154(b) by 214 days.

(21) Appl. No.: 17/677,722

(22) Filed: Feb. 22, 2022

(65) Prior Publication Data

US 2023/0057280 A1 Feb. 23, 2023

Related U.S. Application Data

(60) Provisional application No. 63/236,177, filed on Aug. 23, 2021.

(51) Int. Cl.
*E04G 21/32* (2006.01)
*E04C 5/16* (2006.01)

(52) U.S. Cl.
CPC ..... *E04G 21/3252* (2013.01); *E04C 5/161* (2013.01)

(58) Field of Classification Search
CPC ..... E04G 21/3252; E04C 5/165
See application file for complete search history.

(56) References Cited

U.S. PATENT DOCUMENTS

| | | | | |
|---|---|---|---|---|
| 4,202,378 | A * | 5/1980 | Bush | B65D 59/06 411/908 |
| 4,314,771 | A * | 2/1982 | Lambert | F16B 7/0426 403/362 |
| 5,943,836 | A | 8/1999 | Kassardjian | |
| D737,120 | S | 8/2015 | Recker et al. | |
| D762,458 | S | 8/2016 | Horne | |
| 2005/0169701 | A1* | 8/2005 | Kies | E04C 5/165 403/293 |
| 2009/0107067 | A1* | 4/2009 | Beery | F16P 1/00 52/301 |
| 2016/0208491 | A1* | 7/2016 | Green | E04C 5/161 |
| 2017/0175391 | A1* | 6/2017 | Hunt | E04G 21/3252 |
| 2018/0298613 | A1* | 10/2018 | Eversberg | E04G 21/3252 |

FOREIGN PATENT DOCUMENTS

| | | | | |
|---|---|---|---|---|
| EP | 1898017 | A1 * | 3/2008 | E04C 5/165 |
| KR | 101285704 | B1 * | 7/2013 | |
| KR | 20170059840 | A * | 5/2017 | |

* cited by examiner

*Primary Examiner* — Theodore V Adamos
(74) *Attorney, Agent, or Firm* — BATEMAN IP; Randall B. Bateman

(57) ABSTRACT

A protective cap to cover impalement hazards, by means of increasing the surface area associated with said hazard may include utilizing a metal plate embedded within a plastic/polymer cap, with a flat top and a receiving shaft housing below, with mechanical means of securing the cap to said hazard with a mechanical plunger. The mechanical plunger is driven from the exterior of the housing by means of rotating a threaded shaft to selectively engage the impalement hazard and compressively hold the protective cap to the impalement hazard.

21 Claims, 7 Drawing Sheets

IMPALEMENT HAZARD PROTECTIVE CAP

BACKGROUND

Field of the Invention

The present invention relates to a cap that is placed over and mechanically fastened to an impalement hazard, to render the hazard safe from impalement for individuals working adjacent the cap. Such impalement hazards are mainly associated with commercial and industrial work areas but may also apply to residential and public areas as well.

State of the Art

Industrial and commercial work areas typically have a range of ever-changing work conditions which often-times expose employees and others to impalement hazards. Impalement hazards typically present themselves when a ridged or semi-ridged object, whose diameter is small enough and who's structure is ridged enough, that with sufficient force or pressure applied to it, can result in penetration into an individual's body, causing injury and potentially death. A death would typically come from an individual falling into or onto the hazard, with the force of which the individual encounters the hazard, causing varying degrees and depths of penetration. Even simply walking into such hazards, however, can cause a person to be impaled and, in the right location, cause serious injury.

These same hazards can cause lacerations to those who come into relatively minor contact with them, due to sharp edges or corners. Both section 29 CFR 1926.701(b), as well as 29 CFR 1926.25(a) relating to the Occupational Safety and Health Act (OSHA), highlight the need to remedy and cover the related impalement hazards associated with each section. Furthermore, the General Duty Clause (section 5(1)(1)) of the Occupational Safety and Health Act requires employers to furnish a workplace which is free from recognized hazards that are causing or are likely to cause death or serious physical harm.

While most people think of rebar when discussing impalement hazard, there are many materials which raise the risk of impalement. These include, but are not limited to, reinforcing steel bars (rebar), other miscellaneous reinforcing steel associated with concrete work, rigid conduit, steel flat formwork stakes/rebar pins, steel round formwork stakes, wooden formwork stakes, wooden stakes, anchor bolts, miscellaneous metal/steel edges that fit within a shaft housing, concrete formwork rod ends, fence pickets, all-thread ends, rigid copper piping, electrical grounding rods, rolling scaffold corner supports, uni-strut support ends, and steel fence u-post.

In an attempt to address such issues impalement protective caps have been developed. Some caps are limited to certain sizes and shapes and rely on a friction fit to hold the cap onto the impalement hazard. The impalement protective caps can suffer from both the degradation of the static means of securing the cap to said impalement hazard, through repeated use, as well as foreign objects being caught in the "shaft" rendering the cap less than effective. Additionally, the caps can be easily removed from the impalement hazard, with or without the knowledge of the person placing the impalement protective cap or even the individual who improperly removed or caused the cap to no longer offer full protection from the impalement hazard.

Often times the removal or displacement of these caps comes as a result of individuals coming into contact with them as they walk by and bump the caps, either directly or with toolboxes, tools, etc., thereby causing them to be knocked off or partially disengaged, due to the type of static fastener utilized within these caps and their ability to remain positively engaged.

Thus, it is desirable to create an impalement hazard protective cap which can secure multiple different impalement hazards, and which can be more securely attached to the hazard.

SUMMARY OF THE INVENTION

The following summary of the present invention is not intended to describe each illustrated embodiment or every possible implementation of the invention, but rather to give illustrative examples of application of principles of the invention. The present invention provides a mechanically secured impalement hazard protective cap which can mitigate a range of impalement hazards and reduce the likelihood of serious injury to an individual from a static object, and which inhibits accidental removal from the impalement hazard.

An impalement protective cap may include a housing having a first portion defining an outwardly extending flange and a second portion forming a body with a void disposed therein. The flange and the body may be formed from metal, or metal or an otherwise puncture resistant material may be disposed within the housing such that the metal or other puncture resistant material is covered by plastic or another durable material.

In accordance with one embodiment of the present disclosure, the void in the body may be generally rectangular.

In accordance with another embodiment of the present disclosure, the void may be oval or circular.

In accordance with another embodiment of the present disclosure the void may be triangular.

In accordance with one or more embodiments of the present disclosure, a plunger may be disposed within the void. In accordance with one embodiment of the present disclosure the plunger may be generally flat on one surface exposed within the void.

In accordance with another embodiment of the disclosure the plunger may include a concave portion exposed within the void in the body.

In accordance with one embodiment of the disclosure, the concave portion may be triangular.

In one embodiment of the disclosure, the concave portion maybe semi-cylindrical.

In one embodiment of the disclosure, the plunger maybe disposed in communication with a screw such that rotation of the screw moves the plunger within the void.

In one embodiment of the disclosure, the screw may be locked in place to hold the position of the plunger.

In accordance with one embodiment of the present disclosures, the housing wall defining void may be tiered so as to provide cross-sectional areas of different dimensions within the void at different levels.

In accordance with one embodiment of the present disclosure, the flange and the body of the cap may be formed from a single piece of plastic or polymer material. The material may be, for example, ABS (Acrylonitrile Butadiene Styrene), HDPE (High Density Polyethylene), LDPE (Low Density Polyethylene) PC (Polycarbonate), PVC (Polyvinyl Chloride), Polyamide (Nylon), HIPS (High Impact Polystyrene), or PP (Polypropylene), or a combination thereof.

In accordance with another aspect of the disclosure, the cap may be formed party of metal and party of a plastic or polymer.

In accordance with another aspect of the disclosure, the plunger may be attached to the bolt so that the plunger does not rotate as it is moved by rotation of the bolt.

BRIEF DESCRIPTION OF THE DRAWINGS

Various embodiments of the present disclosure are shown and described in reference to the numbered drawings wherein.

Figure 1:
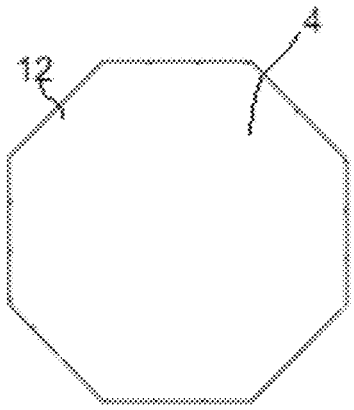
FIG. 1 shows a top view of an impalement hazard cap formed in accordance with the principles of the present disclosure.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the apparatus and methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other, or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without being exactly that quality. For example, a structure said to be generally vertical would be more vertical than horizontal, i.e., would extend greater than 45 degrees from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range, or the characteristics being described.

Turning now to FIGS. 1 through 4, there is shown a top view, two side views and a bottom view of an impalement hazard protective cap 4 formed in accordance with the present disclosure. The impalement hazard protective cap 4 reduces impalement hazards, by means of increasing the surface area associated with said hazard. This is typically done by the cap 4 forming a housing 6 having a first, impact surface portion 8 which extends as a flange 12 from a second, body portion 16 which is designed to receive an impalement hazard. The entire impalement hazard protective cap 4 may be made from metal, or the cap may be made from a plastic or polymer material which covers one or more inserts which provide strength and puncture resistance to the plastic or polymer of the housing 6.

Figure 9:
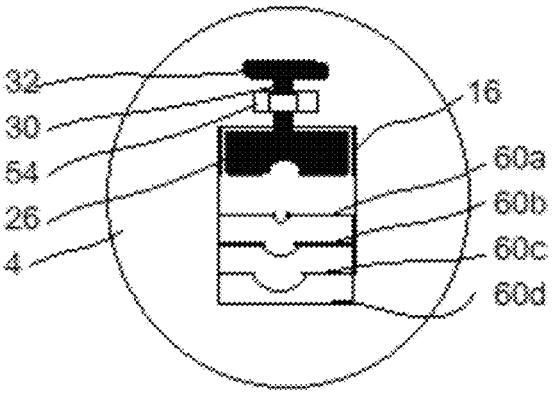
FIG. 9 shows a bottom view of an embodiment similar to that shown in FIGS. 7 and 8 with a rectangular second, body portion.
Figure 10:
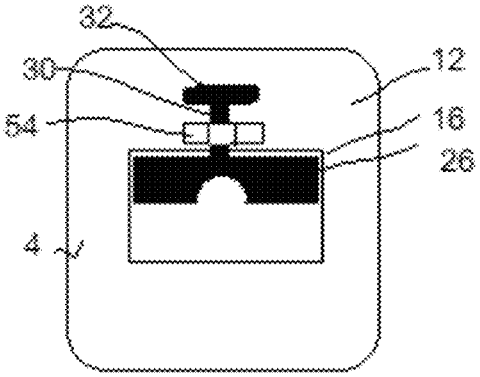
FIG. 10 shows a bottom view of another embodiment.

The first, impact surface portion 8 is preferably between 3 and 6 inches across. More preferably the first, impact surface portion is between 4 and 5 inches across, with a most common size being about 4.5 inches. Such a size dramatically increases the cross-sectional area which a body may engage and dramatically reduced the risk of a person being impaled if they run into or fall onto the first, impact surface portion 8. While shown in most views as being an octagon shape, it will be appreciated that the first, impact surface can be other shapes as well, including generally square or rounded as shown in FIGS. 9 and 10, and other shapes which help spread the impact area while reducing sharp edges, etc.

The first, impact surface portion 8 will typically be approximately $\frac{1}{8}^{th}$ to ½ inch thick. A more preferred range is between about $\frac{1}{4}^{th}$ inch and ⅜ths of an inch. It will be appreciated that a preferred thickness may depend on the specific materials being used to construction. For example, if a steel insert is being used, the first, impact surface may be thinner than if an insert such as aluminum or Teflon is being used as the insert. Additionally, the overhang on the flange 12 is preferably between about ½ of an inch and 1¼ of an inch, with about $\frac{7}{8}^{th}$ of an inch beyond the widest part of the second, body portion 16 being presently preferred.

Figure 2:
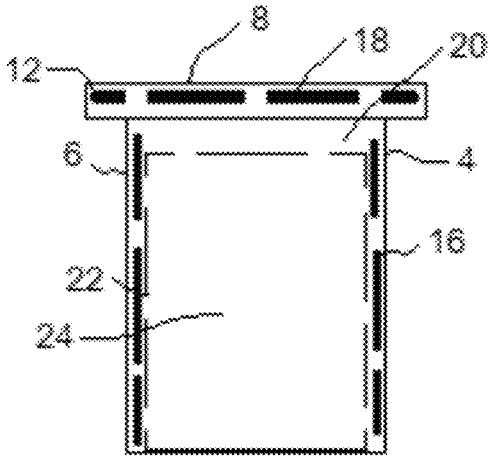
FIG. 2 shows a first side view of the impalement hazard cap formed in accordance with FIG. 1.

As shown in FIG. 2, the first impact portion 8 of the housing 6 may be formed of a metallic body overcoated with plastic or polymer, or may include one or more inserts for providing strength and rigidity to the housing 6. A first metallic plate 18 may be formed from part of the first impact surface portion 8 along with a coating of polymer or plastic material 20. Alternatively, the housing 6 may be made from a material which is sufficiently hard that an impalement hazard could not breach the first, impact portion 8 even if a person were to fall on the impalement hazard protective cap 4.

A second metallic insert 22 forming a portion of at least one sidewall of the second, body portion 16 may be used to provide strength to the at least one side wall of the second, body portion. The second metallic insert 22 may be a single insert on one portion of the body portion, may be multiple inserts around the body portion, or may be a tubular structure so that a single insert is disposed along the entire sidewall of the second, body portion 16.

Figure 3:
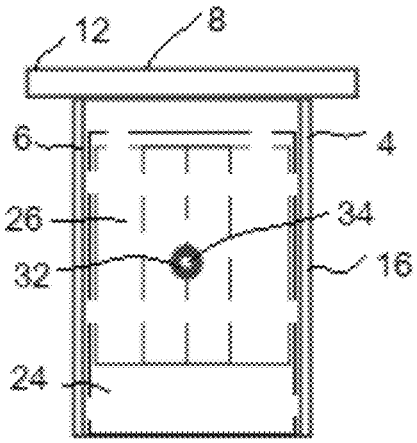
FIG. 3 shows an opposing side view from FIG. 2.
Figure 4:
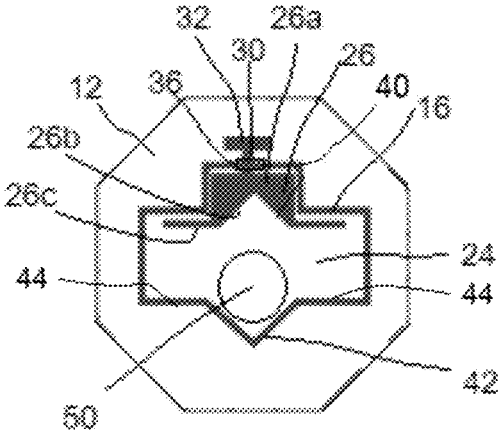
FIG. 4 shows a bottom view of the impalement hazard cap of FIG. 1 with a cylindrical impalement hazard disposed therein.
Figure 16:
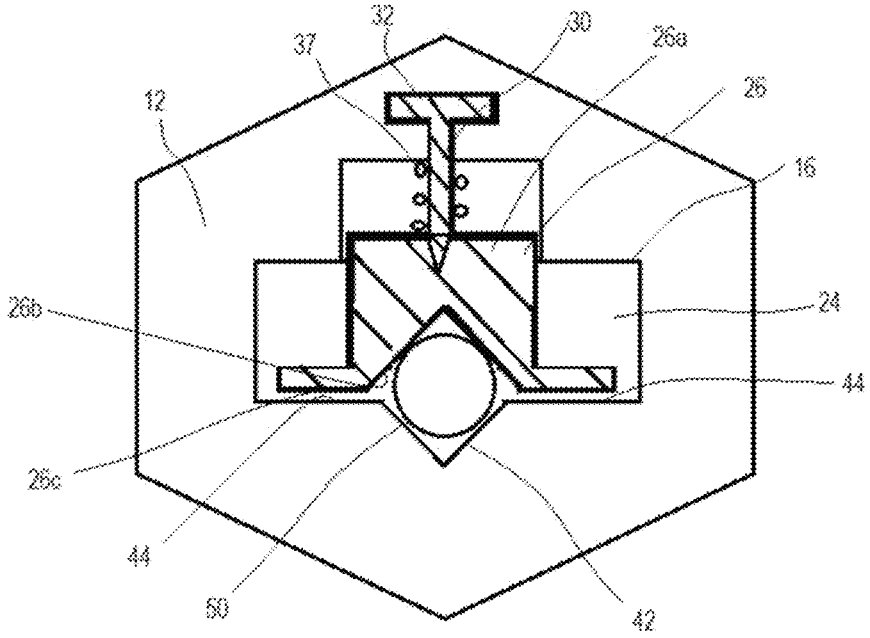
FIG. 16 shows a spring-loaded protective cap.

The second, body portion 16 may include a void 24 into which an end of an impalement hazard may be placed. As shown in FIGS. 3 and 4, a mechanical means of securing the cap 4 to an impalement hazard may be provided. This may be accomplished with a mechanical plunger 26 disposed in the void 24. The mechanical plunger 26 may be spring loaded so that when the spring 37 is released, the spring forces the plunger 26 into contact with an impalement hazard 50 disposed in the void 24 to frictionally engage the impalement hazard and hold it in the void as shown in FIG. 16. Alternatively, the plunger 26 may be mounted on the end of a bolt 30 and driven from the exterior of the housing 6 by means of rotating the threaded shaft of the bolt. Rotating the shaft clockwise drives the plunger 26 in one direction, such as advancing the plunger to engage and secure the end of the impalement hazard within the void 24—pressing the impalement hazard between the plunger and the opposing sidewall of the second, body portion 16 of the housing. Rotating the bolt 30 counterclockwise causes the opposite movement—such as drawing back the plunger 30 away from and disengaging the impalement hazard. The plunger 26 may engage the impalement hazard by tension/friction with a compressive force which holds the impalement hazard protective cap 4 on the impalement hazard. Unlike traditional caps which wear away and provides less frictional engagement with a given size impalement hazard over time, advancing the plunger may still result in engagement even after thousands of uses.

As shown in FIG. 3, the bolt 30 may include a head 32. The head may have a depression 34 formed therein for receiving the head of a screwdriver (i.e., flat head, Phillips head, torx, hex, etc.) so that the bolt may be advanced with a screwdriver or drill with a screwdriver head. The head 32 may also have a shape (hex head, etc.) so that the head may be engaged with a socket for driving the bolt 30 in either direction. The head 32 may also have wings that extend off each opposite side, to allow for tightening of the bolt 30, with hand and thumb force only. It will also be appreciated that the wall of the second, body portion 16 may have an insert 36 which is threaded for engaging threads on the bolt.

FIG. 4 shows a bottom view of the impalement hazard protective cap 4 so that the void 24 and plunger 26 in the second, body portion 16 are visible. It will be appreciated that the second, body portion 16 can be a variety of different shapes. For example, in FIG. 4 the body portion 16 is generally rectangular but includes a first alcove or channel 40 on one side for receiving a portion of the body 26*a* of the plunger 26. An opposing second alcove or channel 42 is generally triangular and may mirror a depression 26*b* in the face 26*c* of the plunger 26. The shape of the face 26*c* of the plunger 26 on either side of the depression 26*b* may be flat and may mirror the opposing wall of the second, body portion 16 enable the impalement hazard protective cap to hold a variety of different shaped impalement hazards.

For example, one of the most common impalement hazards on a construction sight is rebar. In order to prevent impalement, a piece of rebar 50 may be disposed in the void 24. Advancing the plunger 26 enables the rebar to be captured between the face 26*b* of the plunger and the alcove 42 or the opposing wall of the second, body portion 16. The triangular recess or depression 26*b* in the face 26*c* of the plunger 26 and the channel 42 in the wall of the second, body portion 16 allows the rebar 50 to be engaged securely and the cap 4 retained on the rebar by rotating the bolt 30 and the plunger. The more compressive the engagement applied by the plunger, the better the rebar 50 is held so that the cap 4 does not come off, and even preventing the cap from rotating around the rebar.

The two triangular recesses formed by the plunger at 26*b* and the channel 42 in the second, body portion helps to center and hold rebar of various thicknesses, as well as impalement hazards which may be of a more squared in cross-section. The flat portions 44 along the wall and on the face 26*c* of the plunger help hold pieces having a longer, flatter cross-sectional area.

The face 26*c* of the plunger 26 also allows the same cap 4 to be used on an impalement hazard which is more rectangular, such as a stake for concrete forms which has a rectangular cross-section. This is advantageous, as a single impalement hazard protective cap 4 can be used for a wide variety of different impalement hazards—minimizing the inventory of caps which must be taken to a job sight.

In one representative example, the shape of the second, body portion 16 and the plunger 26 allows for the cap 4 to be utilized both on round shaped elements, up to approximately 1½" in diameter, as well as rectangular objects, up to approximately 1¾"×⅝" in thickness. These objects may include but are not limited to:

a. Reinforcing steel bars
b. Miscellaneous reinforcing steel associated with concrete work
c. Rigid conduit
d. Steel Flat formwork stakes/Rebar pins
e. Steel round formwork stakes
f. Wooden formwork stakes
g. Wooden stakes
h. Anchor bolts
i. Miscellaneous metal/steel edges that fit within the shaft housing
j. Concrete formwork rod ends
k. Fence pickets
l. All-thread ends
m. Rigid copper piping
n. Electrical grounding rods
o. Rolling scaffold corner supports
p. Uni-strut support ends
q. Steel fence u-post.

Figure 4A:
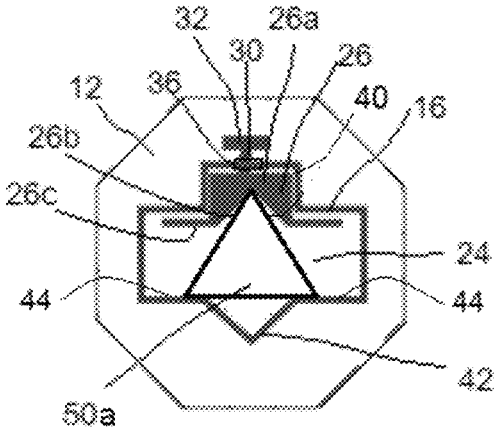
FIG. 4A shows a bottom view of the impalement hazard cap of FIG. 4 with a triangular impalement hazard disposed therein.

FIG. 4A shows the impalement hazard protective cap 4 of FIG. 4 being used on a triangular hazard. One point of the triangle can be disposed in the alcove 42 or the depression 26B in the plunger. The opposing flat side of the triangle can engage the flat portions 44 of the wall or the flat face 26*c* of the plunger 26.

Figure 4B:
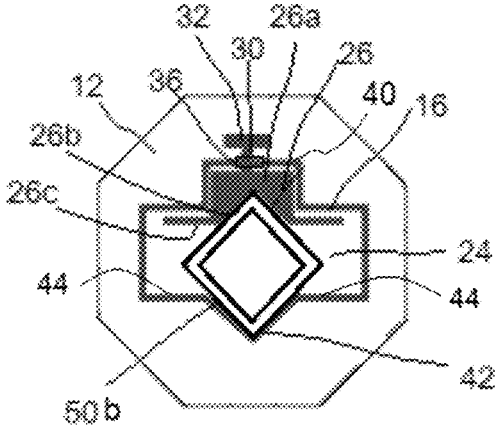
FIG. 4B shows a bottom view of the impalement hazard cap of FIG. 4 with a rectangular impalement hazard disposed therein.

FIG. 4B shows the impalement hazard protective cap 4 being used with a square pipe. It will be appreciated that longer rectangles could be held between the portions 44 of the walls and the flat portions 26*c* of the plunger 26. It will be appreciated that to keep the present disclosure brief, not every aspect of the present disclosure is shown or discussed with respect to every image. It will also be appreciated that any structure discussed with respect to one image may be used in conjunction with the structure shown in any other image. Thus, each different embodiment should be understood as potentially having any aspect discussed herein unless indicated to the contrary.

Figure 5:
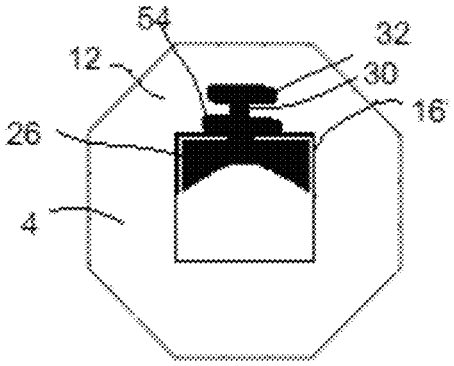
FIG. 5 shows a bottom view of an alternate embodiment of an impalement hazard cap.

Turning now to FIG. 5, there is shown an embodiment of an impalement hazard protective cap 4 made in accordance with the present disclosures. The various aspects of the cap 4 discussed above may be incorporated in the embodiment shown in FIG. 5 which differs principally in the shape of the second, body portion 16. Rather than using an elongate, generally rectangular sidewall, the sidewall 16' is generally square. Additionally, the plunger 26' has a face 26*c* which is generally frustoconical. Such a configuration may be desirable for certain types of impalement hazards such as rebar, etc. when one is unlikely to encounter other shapes as discussed above.

One item shown in FIG. 5 which was omitted from FIGS. 1-4 but would likely be present in such an embodiment is a locking nut 54 disposed along the bolt 30. The locking nut 54 engages the side of the second, body portion and helps to prevent the pressure being applied by the bolt from gradually working the bolt loose. Once desired engagement has been achieved by advancing the plunger 16', the locking nut 54 may be advanced to engage the sidewall of the second, body portion 16' and thereby provide additional assurance that the plunger 26' will remain in the desired position.

Figure 6:
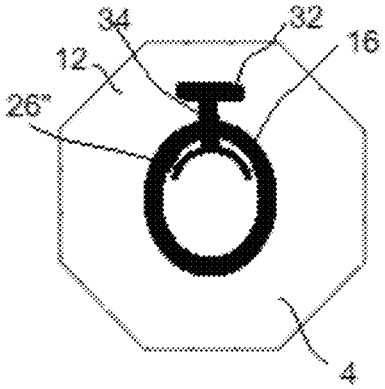
FIG. 6 shows a bottom view of another embodiment of an impalement hazard cap.

FIG. 6 shows an alternate configuration of an impalement hazard protective cap 4 which is designed for use specifically with rebar and other cylindrical hazards. The second body portion 16" is formed by a generally round sidewall, and the plunger 26" is formed to have a rounded concave configuration so as to receive and affirmatively grip a piece of rebar. While shown as having a single arc of curvature, it will be appreciated that the plunger 26" could have multiple arcs so that that the cap 4 could be used with multiple different sizes of rebar.

Figure 7:
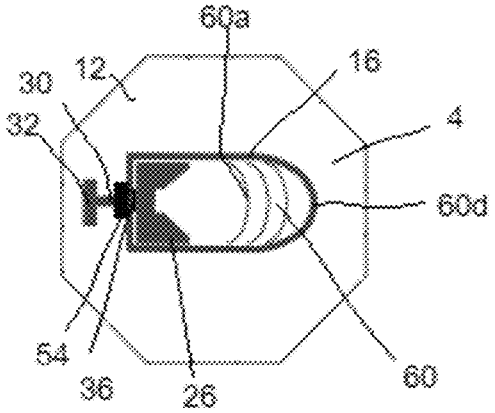
FIG. 7 shows a bottom view of yet another embodiment of an impalement hazard cap.
Figure 8:
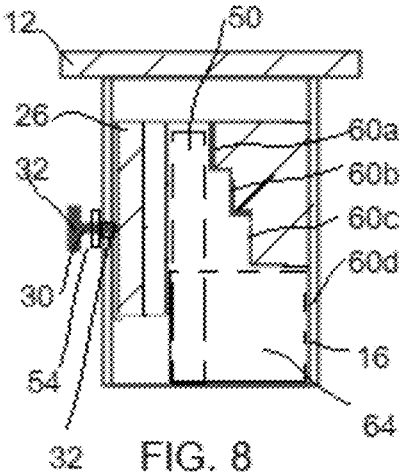
FIG. 8 shows a side cross-sectional view of the embodiment shown in FIG. 7.

FIGS. 7 and 8 show an alternate embodiment of an impalement hazard protective cap 4 which has similar aspects as to the embodiment discussed above and which are included herein by reference. The primary difference with the embodiment shown in FIGS. 7 and 8 is that housing has a plurality of steps 60 is formed within the second, body portion 16 so that adjacent the top of the second, body portion the distance between the plunger 26 and a first step 60*a* forming an inner sidewall of the second, body portion 16 is smaller than the adjacent next step 60*b*, which is smaller than at the next step 60*c*. The distance between the plunger 26 and the bottom step 60*c* is the largest, the providing a tiered void inside the cap 4 having two or more cross-sectional areas.

The steps 60 allow a wide variety of impalement hazards to be held by a single protective cap 4. For example, small pieces of rebar 50 can be held between the plunger 26 and the uppermost step (i.e., innermost sidewall) 60*a*. In contrast, a substantially wider structure, such as a form stake 64, can be held between the plunger 26 and the bottom step (i.e., outermost sidewall having the largest interior distance from the opposing sidewall) 60*d*.

The plunger 26 shown in FIGS. 7 and 8 may have a frustoconical cross-section, or may include a triangular or rounded depression as shown in the previous embodiments. The different surfaces of the plunger 26 assist the plunger in gripping the structure being held when the bolt 30 is tightened.

As shown in bottom view of FIG. 7, the surfaces of the steps may be rounded. Alternatively, as shown in bottom view in FIG. 9, the engagement surfaces of the steps (i.e., the face which engages the impalement hazard), may be flat or a combination of flat surfaces and concave portions, either rounded or triangular. FIG. 9 also shows that the first, impact surface portion 8 need not be octagonal, but may be round as well. The other portions shown in FIG. 9 may include the bolt 30, bolt head 32, locking washer 54 and other structures previously discussed. The shape of the second, body portion 16 shown in FIG. 9 accommodates a wide variety of impalement hazards and thus may be to eliminate the threat to workers by almost all commonly faced impalement risks.

FIG. 10 shows a bottom view of yet another impalement hazard protective cap 4. The first, impact surface portion 12 is in the shape of a rounded square and the second, body portion 8 is generally rectangular. The plunger 26 may include flat surfaces and concave portions disposed opposite a generally flat inner wall of the second, body portion. It will be appreciated that if sufficiently tightened, virtually any shape plunger will work. However, the concave recesses enable gripping of certain shapes such as square or triangles with additional frictional area to ensure that the protective cap does not come loose.

Figure 11:
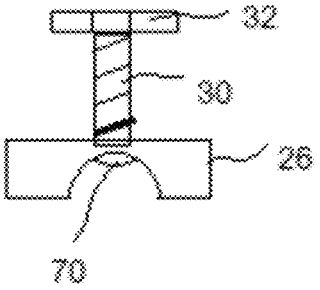
FIG. 11 shows a side view of a plunger and a means for moving the plunger within the second, body portion of the housing forming the protective cap.

It will be appreciated that it is preferred that the plunger be allowed to advance and retract without rotating with the rotations of the bolt. This can be accomplished in several ways. The bolt 30 may have a flange which fits into a void in the back of the plunger, or with a rivet 70 or other structure may extend into the bolt as to attach the bolt to the plunger while allowing them to rotate with respect to one another as shown in FIG. 11. Alternatively, the bolt may not be threaded all the way to the end of the of the bolt which engages the plunger so that the rotation of the bolt moves but does not rotate the plunger 26. The plunger 26 may be made from metal or other rigid material and coated with a high friction material such as rubber or neoprene, or may be made from a semi-rigid material to promote friction between the plunger and the impalement hazard being held.

Figure 12:
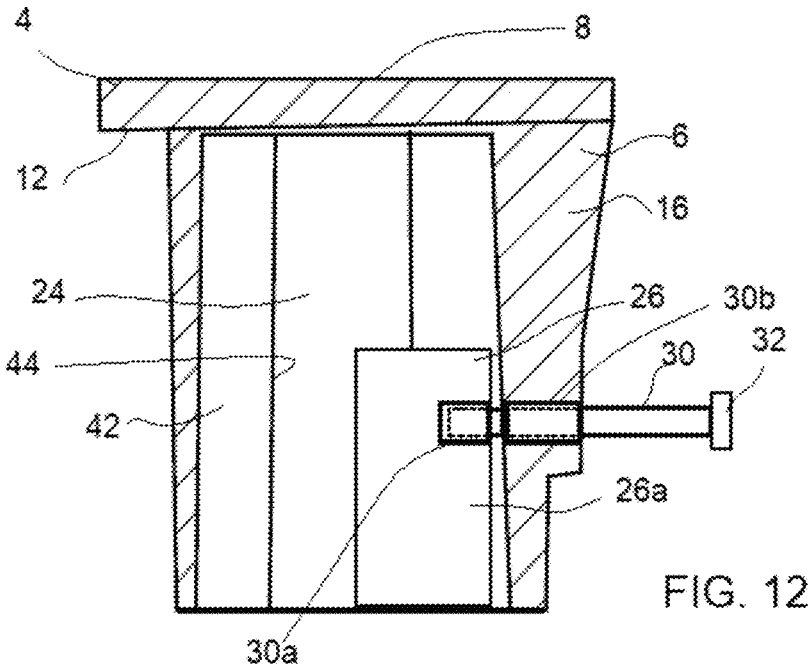
FIG. 12 shows a cross-sectional view of an impalement hazard protective cap.

Turning now to FIG. 12 there is shown a cross-sectional view of an impalement hazard protective cap 4 which may be formed from a single piece of material. While the material may be metal, other materials such as ABS (Acrylonitrile Butadiene Styrene), HDPE (High Density Polyethylene), LDPE (Low Density Polyethylene) PC (Polycarbonate), PVC (Polyvinyl Chloride), Polyamide (Nylon), HIPS (High Impact Polystyrene), or PP (Polypropylene), could also be used.

The impalement hazard protective cap 4 may include a body 6 which includes the first, impact surface portion 8, which may include a flange 12, and a second body portion 16 which defines a void 24 into which an impalement hazard may be inserted. A plunger 26 may be disposed in the void 24 and a bolt 30 may have and end 30*a* which engages the plunger to move it forward or backward within the void depending on the rotation of bolt. The housing 16 may be threaded, or a threaded collar 30*b* may be provided so rotation of the bolt 30 moves the plunger 26 in the void 24 toward or away from the opposing wall 44 (FIG. 13).

Figure 13:
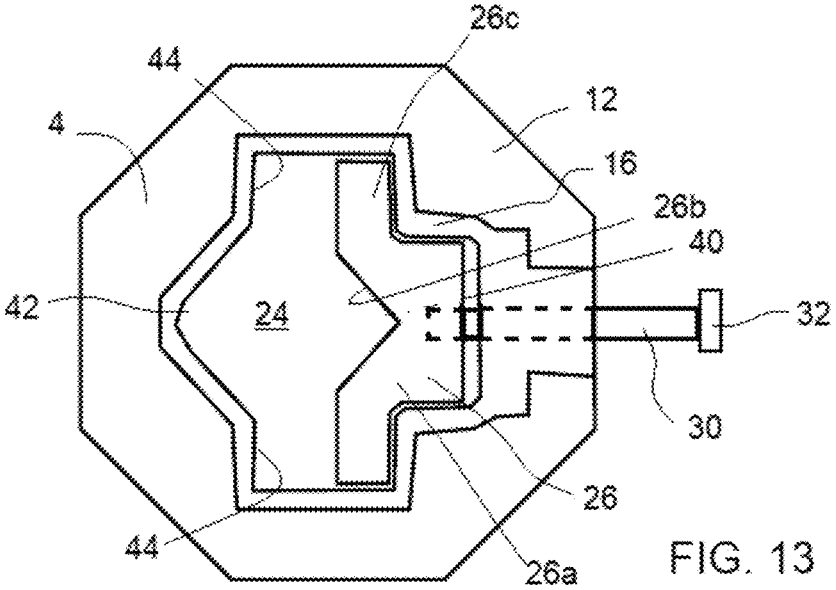
FIG. 13 shows a bottom view of the impalement hazard protective cap of FIG. 12.

FIG. 13 shows a bottom view of the impalement hazard protective cap 4 with the plunger 26 in a first, open position designed for receiving an impalement hazard into the void in the second body portion 16. By rotating the bolt 32, the plunger 26 can be moved toward the opposing wall 44 to pinch the impalement hazard between the plunger and the wall 44 or the wall portion forming channel 42.

Figure 14:
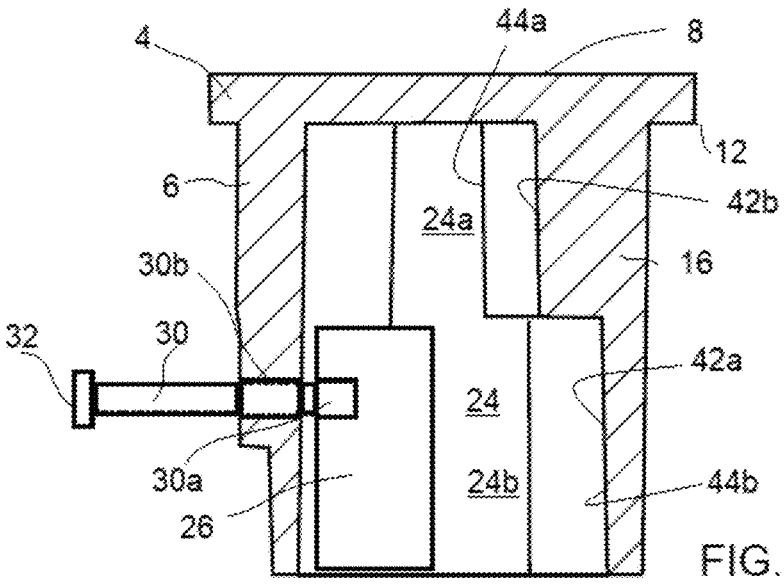
FIG. 14 shows a cross-sectional view of an impalement hazard protective cap.
Figure 15:
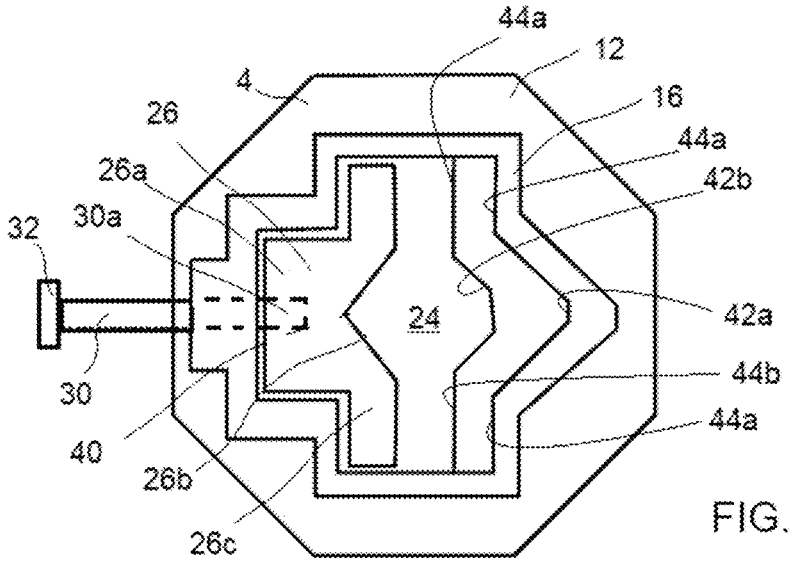
FIG. 15 shows a bottom view of the impalement hazard protective cap of FIG. 14.

FIG. 14 shows a side view of an impalement hazard protective cap similar to FIG. 12, but wherein the wall of the second body portion 16 is tiered to allow impalement hazards of different sizes to be contained in the void 24. A first, upper portion 24*a* of the void has a wall 44*a* to provide one cross-sectional area, while a second, lower portion 24*b* has a wall 44*a* which provides a second, larger cross-sectional area. Advancing the plunger 26, allows the plunger to engage an impalement hazard (not show) and engage it between the plunger and the wall 44*a* or wall 44*b* depending on the size of the impalement hazard disposed in the void 24. A bottom view of the impalement hazard protective cap 4 is shown in FIG. 15.

It will be appreciated that the present disclosure discloses multiple embodiments and combinations, and which can be used to form an impalement hazard protective cap, which may include a protective cap for impalement hazards which includes a housing having a first, impact surface portion and a second, body portion having a void therein for receiving an impact hazard and a plunger movable within the void. The cap's the first, impact surface portion may have a penetration resistant insert disposed therein or may be made exclusively of a polymer or plastic material. The second body portion may have a sidewall containing an insert.

The plunger of the protective cap may have a concave surface. The concave surface may be rounded or may form a portion of a triangle. The concave surface may be frustoconical. The plunger may also have a plurality of flat surfaces adjacent the concave surface.

The protective cap may have a second, body portion with a plurality of steps formed within the second, body portion so that the void in the second, body portion has a void with areas having different cross-sectional areas. The steps may include concave surfaces facing the plunger which provide two or more areas within the void having different cross-sectional areas.

The protective cap may include a bolt attached to the plunger such that rotation of the bolt moves the plunger within the second, bod portion. The second, body portion may include a sidewall defining a generally rectangular area. The cap may include a sidewall contains at least one channel extending outward from a generally rectangular area and a portion of the plunger may be disposed in the at least one channel. The at least one channel may include a channel disposed opposite the plunger. The second, body portion may be generally square in cross-section. The plunger may be rotatably attached to the bolt which extends through a sidewall of the second, body portion such that rotation of the bolt moved the plunger toward or away from said sidewall without rotating the plunger. The cap may include a threaded insert or collar disposed in the second, body portion and the bolt is disposed in the threaded insert.

A method for securing an impalement hazard, may include selecting an impalement hazard cap having a first, impact surface portion and a second, body portion defining a void; disposing an end of the impalement hazard within the void; and rotating a bolt to advance a plunger disposed in the void to engage the impalement hazard and push the impalement hazard into contact with an opposing side of the second, body portion to thereby compressively engage the impalement hazard between the plunger and the sidewall of the second, body portion. The method may include rotating a bolt to advance the plunger within the housing.

Thus, there is disclosed an impalement hazard protective cap. It will be appreciated that multiple modifications can be made to the disclosed embodiments which would be obvious to one of ordinary skill in the art in light of the present disclosure and the appended claims are intended to cover such modifications.

This application hereby incorporates by references U.S. Provisional Patent Application No. 63236177 filed Aug. 23, 2021.

What is claimed is:

1. A protective cap for impalement hazards comprising:

a housing with an impact surface and a body portion extending away from the first impact surface, the body portion having a sidewall defining a void having a generally rectangular portion, the sidewall forming a side portion with flat surfaces along the generally rectangular portion of the void and a concave channel extending from the generally rectangular portion of the void between the flat surfaces so that a flat surface is disposed on opposing sides of the concave channel; and a plunger at least partially disposed in the generally rectangular portion of the void, the plunger comprising arms disposed in alignment with the flat surfaces of the sidewall and a concave depression formed into the plunger between the arms.

2. The protective cap for impalement hazards of claim 1, wherein the a portion of the housing having the impact surface has a first penetration resistant insert disposed therein.

3. The protective cap for impalement hazards of claim 2, wherein the body portion has a sidewall containing a second insert.

4. The protective cap for impalement hazards of claim 1 wherein the concave depression in the plunger has a concave surface formed by two straight walls forming a portion of a triangular shape.

5. The protective cap for impalement hazards of claim 4, wherein the concave channel in the sidewall is formed by two straight walls forming a portion of a triangular shape extending in the opposite direction as the depression in the plunger so that the concave channel and the concave depression form mirror images of each other.

6. The protective cap for impalement hazards of claim 4, wherein the concave channel is frustoconical.

7. The protective cap for impalement hazards of claim 1, further comprising a spring disposed adjacent the plunger and wherein the plunger is spring loaded to push the plunger into the void.

8. The protective cap for impalement hazards of claim 1, wherein the concave channel is rounded and wherein the concave depression in the plunger is rounded.

9. A protective cap for impalement hazards of claim 1, wherein a plurality of steps is formed by the sidewall of the second, body portion, each of the steps having a concave channel formed therein in alignment with the concave depression of the plunger.

10. A protective cap for impalement hazards of claim 9, wherein the concave channel of each step faces the plunger, and wherein the concave channels on different steps are of different sizes to receive impalement hazards of different sizes.

11. A protective cap for impalement hazards of claim 1, further comprising a bolt attached to the plunger such that rotation of the bolt moves the plunger within the body portion.

12. A protective cap for attachment on an impalement hazard, comprising:

a housing having a generally flat impact surface and a body portion extending away from the generally flat impact surface, the body portion having a sidewall defining a void, the sidewall forming a plurality of steps, each step of the plurality of steps having a concave channel formed therein for engaging one side of an impalement hazard, and a plunger disposed within the void, the plunger having a concave depression formed therein generally opposite of and in alignment with the concave channels formed in the plurality of the steps for engaging an opposing side of an impalement hazard to hold the impalement hazard against the sidewall of the body portion.

13. A protective cap for attachment on an impalement hazard of claim 12 wherein the plunger is moveable between a first, open position wherein an area between the plunger and the sidewall defines a generally rectangular area with the concave channel on one side and the concave depression on the other side of the generally rectangular area.

14. A protective cap for attachment on an impalement hazard of claim 13, wherein a portion of the plunger extends outwardly from the concave depression for engaging a side of an impalement hazard having a rectangular cross-section.

15. A protective cap for attachment on an impalement hazard of claim 14, wherein the sidewall has a flat surface on either side of the concave channel for engaging a generally flat side of an impalement hazard.

16. A protective cap for attachment on an impalement hazard of claim 12, wherein the second, body portion is generally square in cross-section.

17. A method for securing an impalement hazard, the method comprising:

selecting an impalement hazard cap having a first, impact surface portion and a second, body portion defining a void;

disposing an end of the impalement hazard within the void; and advancing a bolt to advance a plunger disposed in the void to engage the impalement hazard and push or maintain the impalement hazard in contact with an opposing side of the second, body portion to thereby compressively engage the impalement hazard between the plunger and the sidewall of the second, body portion, and wherein the sidewall has flat portions so that the plunger may hold rectangular structures between the plunger and the flat portions of the sidewall, and wherein the plunger has a concave depression and the sidewall contains a concave channel in alignment with the concave depression such that impalement hazards having a square or round cross-section can be disposed in the concave depression and concave channel to hold the impalement hazard between the plunger and the sidewall in the concave depression and the concave channel.

18. The method of claim 17, wherein the method comprises spring loading the plunger toward the sidewall.

19. The method according to claim 17, wherein the method comprising selecting an impalement hazard having a generally square cross-section and disposing the impalement hazard so that one corner of the square cross-section of the impalement hazard is disposed in the concave channel and an opposing corner of the square cross-sectional of the impalement hazard is disposed in the concave depression.

20. The method according to claim 17, wherein the method comprises selecting disposing a generally cylindrical impalement hazard in the body portion and advancing the plunger so that the generally cylindrical impalement hazard is engaged by surfaces of the concave channel and by surfaces of the concave depression to thereby secure the generally cylindrical impalement hazard.

21. The method according to claim 17, wherein the plunger has arms extending from a portion of the plunger defining the concave depression and wherein the method comprises disposing an impalement hazard having a rectangular cross-section and advancing the plunger to that the impalement hazard is held between the arms of the plunger and the flat portions of the sidewall.

* * * * *